US005226865A

United States Patent [19]

Chin

[11] Patent Number: 5,226,865

[45] Date of Patent: Jul. 13, 1993

[54] PORTABLE EXERCISE STEPPING STOOL

[76] Inventor: Taan K. Chin, 7th Fl., No. 227, Sec. 3, Roosevelt Rd., Taipei, Taiwan

[21] Appl. No.: 986,265

[22] Filed: Dec. 7, 1992

[51] Int. Cl.[5] ..... A63B 22/00

[52] U.S. Cl. ..... 482/52; 108/144; 248/188; 297/439

[58] Field of Search ..... 482/51, 52; 108/144, 108/157; 248/188, 165; 297/439

[56] References Cited

U.S. PATENT DOCUMENTS

| | | | |
|---|---|---|---|
| 1,645,336 | 10/1927 | McGlothern | 248/165 X |
| 2,334,912 | 11/1943 | Eide | 248/165 X |
| 2,615,770 | 10/1952 | Curtis | 248/165 |
| 4,678,234 | 7/1987 | Wilson | 297/439 |
| 4,919,113 | 4/1990 | Hogberg | 108/157 |
| 5,154,678 | 10/1992 | Adamczyk et al. | 108/157 X |
| 5,158,512 | 10/1992 | Irwin et al. | 482/52 |

FOREIGN PATENT DOCUMENTS

| | | | |
|---|---|---|---|
| 8703498 | 7/1988 | PCT Int'l Appl. | 297/439 |

*Primary Examiner*—Gene Mancene
*Assistant Examiner*—L. Thomas
*Attorney, Agent, or Firm*—Perman & Green

[57] ABSTRACT

A portable exercise stepping stool includes a pair of base members and a top plate. Each base member is an arch from a side view and the lateral sides thereof are arch-shaped which is thicker at a bottom portion thereof and thinner at an upper portion thereof. A pad is provided at one corner of each leg of the base members for absorbing stepping impact by an exerciser. The top plate has two lateral insert members each for engaging with an associated groove which is formed in and extends along a height of an inward side of the base members. The top plate and the base members are secured together. The stepping stool further includes a stepping plate detachably mounted to a bottom thereof. At the bottom of the stepping stool is a socket member for receiving a plug member on one side of the stepping plate which also has a socket member on the other side thereof for further receiving the plug member of another stepping plate.

3 Claims, 4 Drawing Sheets

PORTABLE EXERCISE STEPPING STOOL

BACKGROUND OF THE INVENTION

The present invention relates to a portable exercise stepping stool with adjustable height.

Portable stepping stools become more and more popular as people lack time and place to exercise. By stepping on and off the stools in time to music or aerobic dance, people may both exercise their body and obtain an entertainment effect. The invention relates to an improved stepping stool which has a more sound structure and is adjustable in height.

SUMMARY OF THE INVENTION

A portable exercise stepping stool in accordance with the present invention includes a pair of base members and a top plate. Each base member is an arch from a side view and the lateral sides thereof are arch-shaped which is thicker at a bottom portion thereof and thinner at an upper portion thereof. A pad is provided at one corner of each leg of the base members for absorbing stepping impact by an exerciser. The top plate has two lateral insert members each for engaging with an associated groove which is formed in and extends along a height of an inward side of the base members. The top plate and the base members are secured together. The stepping stool further includes a stepping plate detachably mounted to a bottom thereof. At the bottom of the stepping stool is a socket member for receiving a plug member on one side of the stepping plate which also has a socket member on the other side thereof for further receiving the plug member of another stepping plate.

Other advantages and novel features of the invention will become more apparent from the following detailed description when taken in conjunction with the accompanying drawings.

DETAILED DESCRIPTION OF THE PREFERRED EMBODIMENTS

Figure 1:
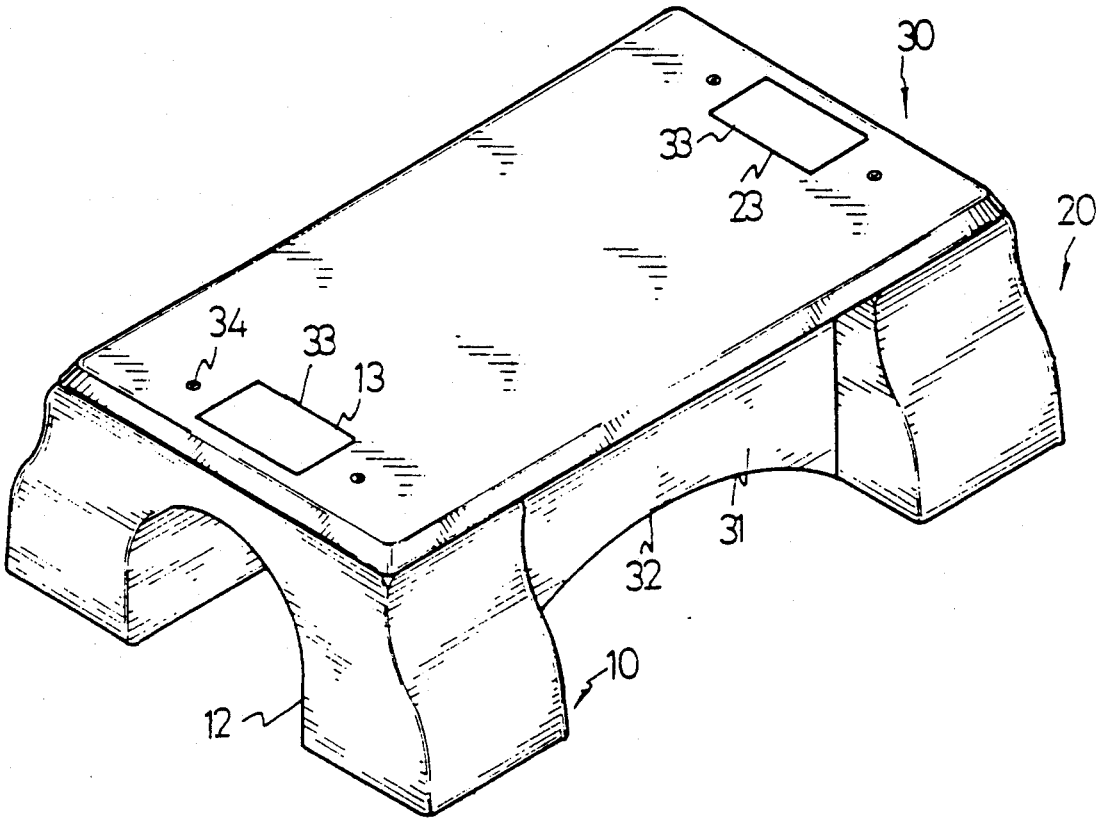
FIG. 1 is a perspective view of a portable exercise stepping stool in accordance with the present invention.
Figure 2:
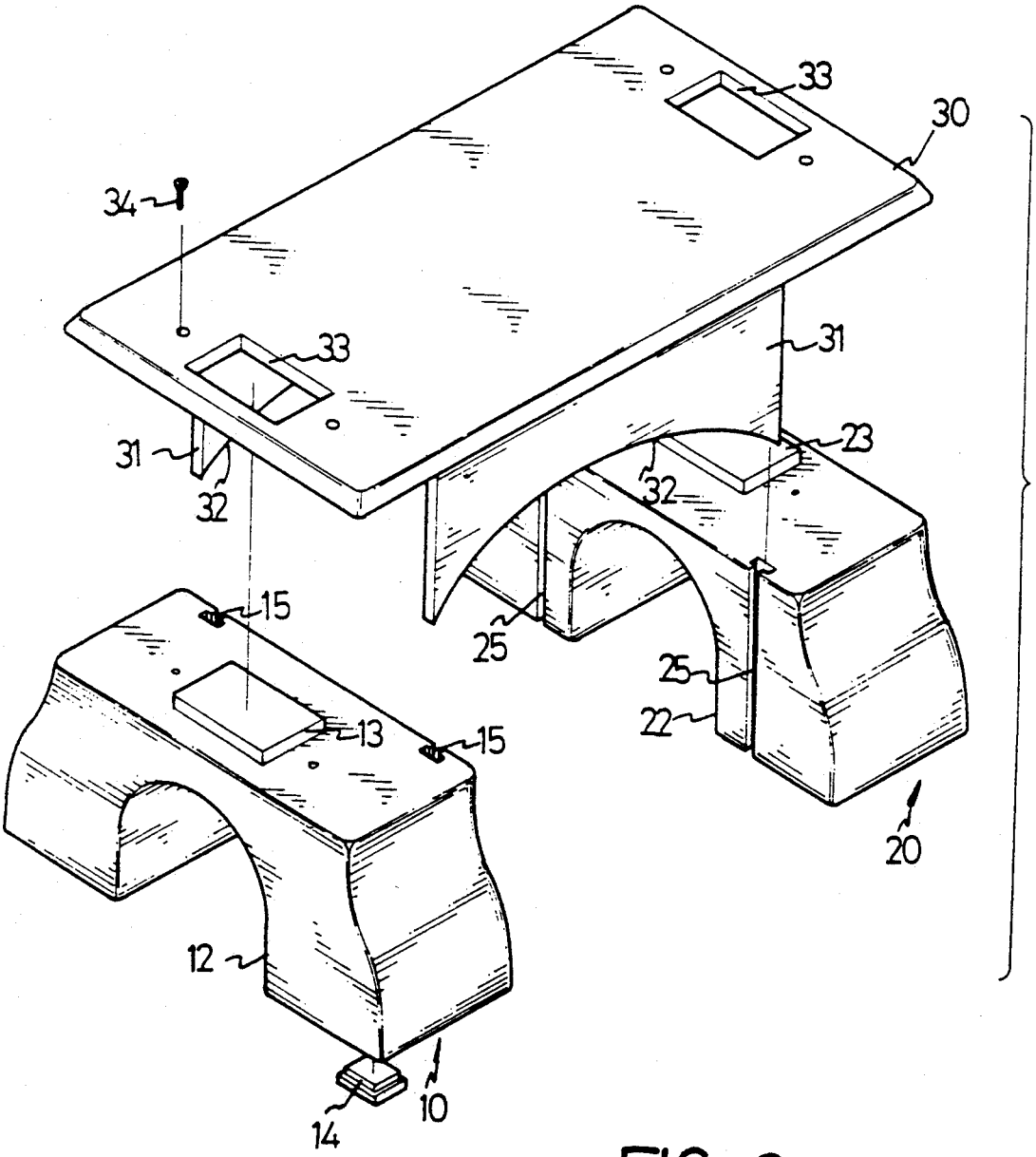
FIG. 2 is an exploded view of the stepping stool in accordance with the present invention.

Referring to FIGS. 1 and 2, a portable exercise stepping stool in accordance with the present invention generally includes a pair of base members 10, 20 and a top plate 30. Each of the base members 10, 20 are substantially arches 12, 22 from a side view and the lateral sides thereof are arch-shaped which is thicker at a bottom portion thereof and thinner at an upper portion thereof. A pad 14 is provided at one corner of each leg of the base members 10, 20 (only one pad 14 is shown) for absorbing stepping impact by an exerciser.

The top plate 30 has two substantially parallel lateral insert members 31 each for engaging with an associated groove 15, which is formed in and extends along a height of an inward side of the base members 10, 20. As shown in the drawings, the lower side of the lateral insert member 31 is cut to form a concave 32. Also shown in FIG. 2 is a substantially rectangular protrusion 13, 23 projecting upward from an upper surface of each base member 10, 20 for mating with a substantially rectangular cutout 33 in both sides of the top plate 30, providing a positioning effect. The protrusions 13 and 23, which are visible after assembly, may have various colors for aesthetic purpose. Screws 34 are provided to secure the top plate and the base members 10, 20 together.

Figure 3:
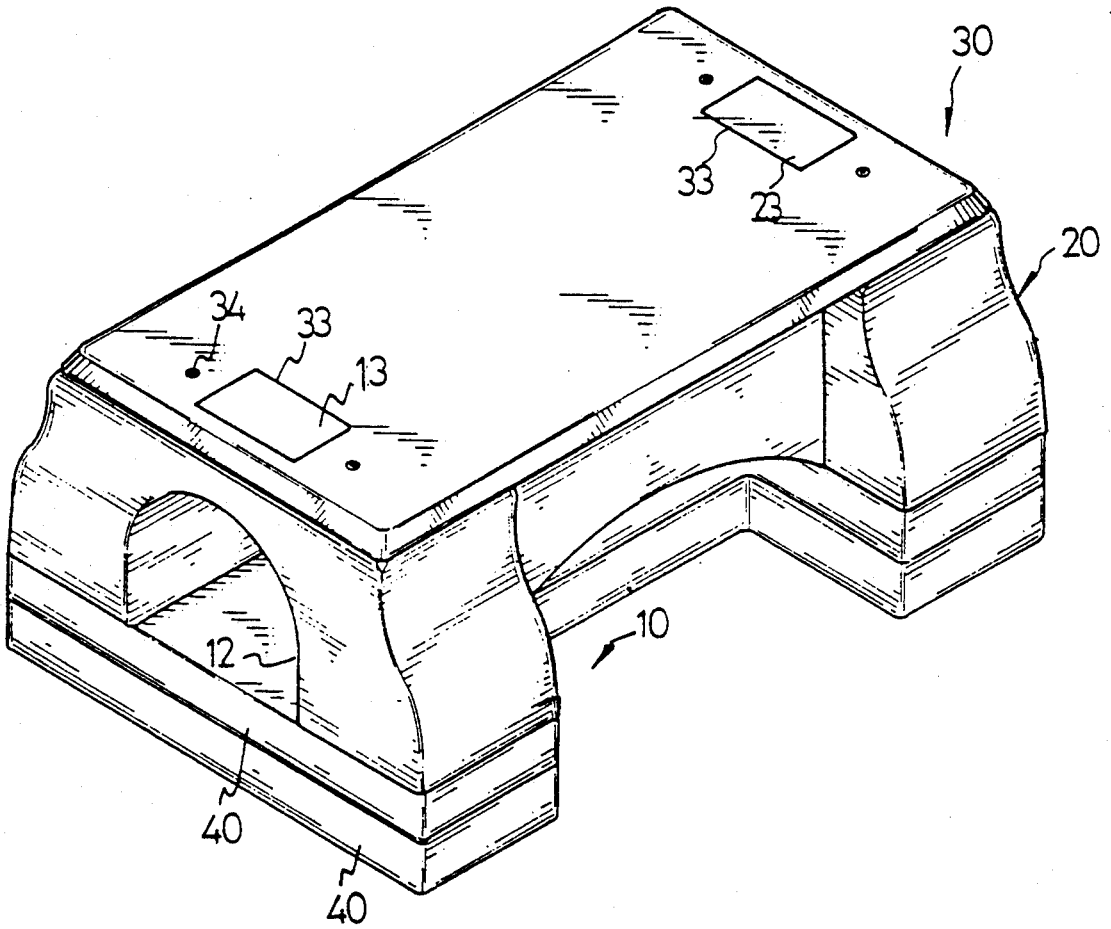
FIG. 3 is a perspective view of the stepping stool with two stepping plates attached to a bottom thereof.
Figure 4:
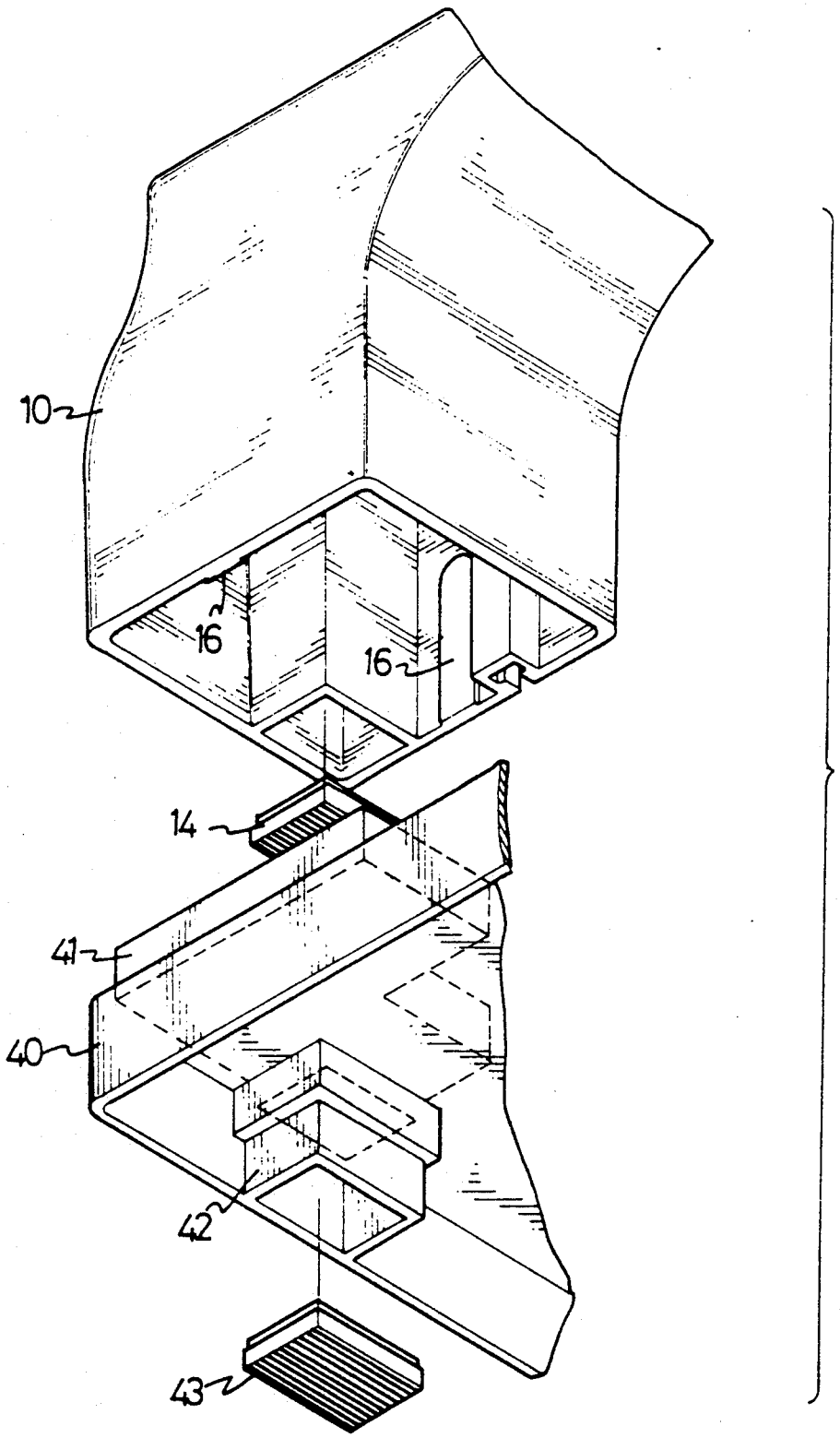
FIG. 4 is a partial bottom perspective view showing the structure of a bottom of the stepping stool and the base plate.

Now referring to FIGS. 3 and 4, when the stepping stool is required to be higher for a tall exerciser or the exerciser who wishes to move his feet higher, additional stepping plates 40 are detachably mounted to a bottom of the stepping stool. As shown in FIG. 4, the bottom of the stepping stool is substantially a socket member for receiving a plug member 41 on one side of the stepping plate 40 which also has a socket member 42 on the other side thereof for further receiving the plug member of another stepping plate 40. Two protrusions 16 are formed in the socket member of the base member 10 for securely retaining the stepping plate 40. A pad 43 may be mounted to the socket member 42 to provide an impact-absorbing function as mentioned in the above.

According to the above, it is appreciated that the stepping stool of the present invention is more stable by means of the structure of the arched sides and arches which increases the impact-absorbing ability of the base members 10, 20. Furthermore, the top plate is made of a thin plate and is beveled at corners to prevent inadvertent injury to the exerciser. The lateral insert plates 31 reinforce the top plate 30 so that the latter has appropriate elasticity for absorbing stepping impact.

Although the invention has been explained in relation to its preferred embodiment, it is to be understood that many other possible modifications and variations can be made without departing from the spirit and scope of the invention as hereinafter claimed.

I claim:

1. A portable exercise stepping stool comprising a pair of base members (10, 20) and a top plate (30), each said base member (10, 20) being an arch (12, 22) with two legs from a side view and the lateral sides thereof being arch-shaped which is thicker at a bottom portion thereof and thinner at an upper portion thereof, a pad (14) is provided at one corner of each leg of said base members (10, 20) for absorbing stepping impact by an exerciser;

said top plate (30) having two substantially parallel lateral insert members (31) each for engaging with an associated groove (15) which is formed in and extends along a height of an inward side of said base members (10, 20), a protrusion (13, 23) projecting upward from an upper surface of each said base member (10, 20) for mating with a cutout (33) in both sides of said top plate (30), providing a positioning effect, and means for securing said top plate (30) and said base members (10, 20).

2. The stepping stool as claimed in claim 1 further comprising a stepping plate (40) detachably mounted to a bottom of said stepping stool, said bottom of said stepping stool being a socket member for receiving a plug member (41) on one side of said stepping plate (40) which also has a socket member (42) on the other side thereof for further receiving the plug member of another stepping plate (40).

3. The stepping stool as claimed in claim 2 wherein a pad (43) is mounted to said socket member (42).

* * * * *